United States Patent [19]

Olson

[11] Patent Number: 4,596,430

[45] Date of Patent: Jun. 24, 1986

[54] ELECTRICAL COUPLER

[76] Inventor: Kenneth D. Olson, 2160 Hinckley Hills Rd., Hinckley, Ohio 44233

[21] Appl. No.: 625,135

[22] Filed: Jun. 27, 1984

[51] Int. Cl.[4] ..... H01R 13/639

[52] U.S. Cl. ..... 339/75 P; 339/103 R

[58] Field of Search ..... 339/75 P, 103 R, 104

[56] References Cited

U.S. PATENT DOCUMENTS

| | | | |
|---|---|---|---|
| 2,725,543 | 11/1955 | Tanner | 339/75 P |
| 2,728,058 | 12/1955 | Phalen | 339/75 P |
| 3,163,481 | 12/1964 | Salvador | 339/75 P |
| 4,097,105 | 6/1978 | Zumwalt | 339/75 P |

FOREIGN PATENT DOCUMENTS

| | | | |
|---|---|---|---|
| 1445657 | 6/1966 | France | 339/75 P |

*Primary Examiner*—John McQuade

*Attorney, Agent, or Firm*—Renner, Otto, Boisselle & Lyon

[57] ABSTRACT

An electrical coupler comprises a receptacle member connected with an electric cable, and a plug member connected with an electric cable. They may be connected to permit electricity to flow between them in the usual fashion. Securing means prevent disconnection of the members caused by axial pulling on the cables. The securing means includes a strap with a flexible mid portion adapted to be wrapped around the cable connected with one of the members. The strap has end portions each with a stud projecting laterally therefrom, and there are a pair of stud receiving sockets in the other of said members. The strap may include a tab for facilitating removal of one of the studs from their sockets.

11 Claims, 6 Drawing Figures

ELECTRICAL COUPLER

BACKGROUND OF THE INVENTION

The present invention relates to an electrical coupler which is resistant to accidental disconnection caused by pulling on cables joined by the coupler.

Some electrical connections are subject to accidental disconnection. This is especially so when one or more extension cords are used. For example, on construction sites it is often necessary to connect one or more extension cords in series between an electric outlet and a power tool. If care is not used while pulling on the cord of the power tool, the connections between the power tool and the extension cord(s) may accidentally be disconnected.

SUMMARY OF THE INVENTION

Accordingly, it is a primary object of the present invention to provide an electrical connection which is resistant to such accidental disconnection. The present invention provides a plug connected with an electrical cord and a receptacle connected with another electrical cord. The plug and receptacle are adapted to be inserted one into the other to provide electrical continuity in the usual manner. The present invention also provides a means for securing the plug and receptacle to one another to keep them connected. The securing means includes a strap made of a plastic material which is wrapped around the cord of either the plug or receptacle and which may be releasably connected with the other of the plug or receptacle. The strap includes a middle portion which has a generally round cross section and flattened end portions. A stud extends outward from each flattened end portion, and both the plug and receptacle are provided with sockets in their side faces which are adapted to receive the studs.

To secure the electrical coupler against accidental disconnection the strap is wound around the cable of, e.g., the plug and the studs on the ends of the strap are inserted into the sockets in the sides of the receptacle. In order to disconnect the electrical coupling, the end portions of the strap are pulled outwardly away from the receptacle to disengage the studs from their sockets, and the studs may then be placed in the sockets in the side wall of the plug for storage and to prevent loss.

The invention, then, comprises the features hereinafter fully described and particularly pointed out in the claims, the following description and annexed drawings setting forth in detail an illustrative embodiment of the invention, this being indicative, however, of but one of the various ways in which the principles of the invention may be embodied.

DESCRIPTION OF PREFERRED EMBODIMENT

Figure 1:
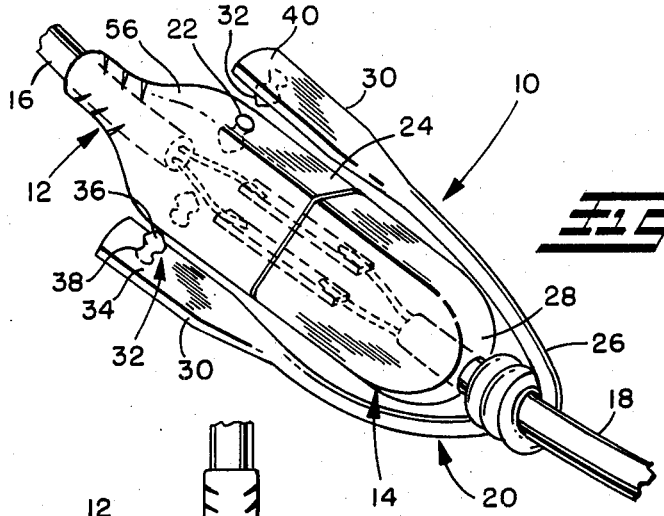
FIG. 1 is an illustration of an electrical coupler constructed in accordance with the present invention.

FIG. 1 illustrates an electrical coupler 10 constructed in accordance with the present invention. The electrical coupler 10 includes a receptacle member 12 and a plug member 14 to each of which is connected an electric cable 16 and 18, respectively. The receptacle member 12 and plug member 14 may be generally of the conventional type in that the plug member may have two, three, or more tines which are connected to the various conductors of the cable 18. The receptacle member 12 includes corresponding electrical contacts which are connected to the various conductors within the cable 16. When the plug member 14 is inserted into the receptacle member 12, an electrical connection is established between the conductors of cable 16 and those of cable 18.

The electrical coupler 10 also includes a strap 20 and a pair of sockets 22 formed in the side walls of the receptacle member 12. Together the strap 20 and sockets 22 cooperate to form a means for preventing disconnection of the plug member 14 from the receptacle member 12 such as might be caused by lengthwise or axial pulling on the electric cables 16 and 18.

The strap 20 is formed from a flexible but substantially inelastic plastic material. The strap 20 includes a mid portion 26 which has a generally rounded cross section and is adapted to be wound around an electric cable such as the electric cable 18. When pulled toward the receptacle member 12, the turns of the strap 20 about the electric cable 18 bear against shoulder 28 of the plug member 14 and prevent the strap from moving.

Figure 3:
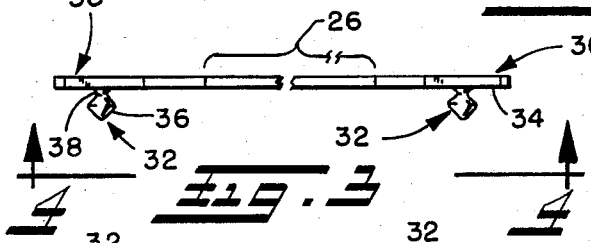
FIG. 3 is a side view of a strap forming a portion of the electrical coupler of FIG. 1.
Figure 4:
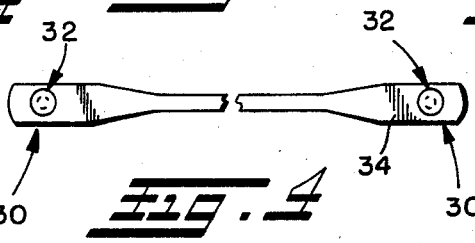
FIG. 4 is a view looking generally in the direction of arrows 4—4 of FIG. 3.

The strap 20 also includes two flattened end portions 30 from each of which projects a stud 32. The studs 32 (FIGS. 3 and 4) project from a major surface 34 of each flattened end portion 30 and include an enlarged head portion 36 and a reduced diameter neck portion 38 between the head and the major surface of the flat end portion 30 of the strap 20. The head 36 tapers as shown from its tip to its maximum diameter.

Figure 2:
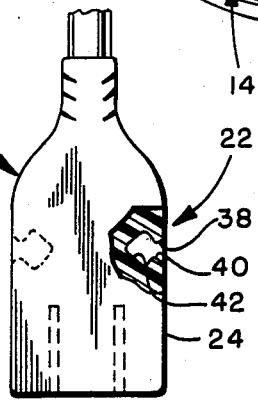
FIG. 2 is a partially cut away view of a receptacle member forming a portion of the electrical coupler of FIG. 1.

The receptacle member 12 is formed of a resilient material. The sockets 22 (FIG. 2) are contoured to fit snugly around the studs 32. To this end the sockets 22 have an inwardly beveled lead in surface 38 which leads to an inwardly projecting shoulder 40 which is undercut to form an enlarged innermost chamber 42. The shoulder 40 fits tightly against the neck 38 of the stud 32 and the head 36 fits in the inner chamber 42.

When the stud 32 is inserted into the socket 22, the tapered tip bears against the beveled surface 38. The stud is firmly retained in the socket because of the resilience of the socket, especially when the strap 20 is subjected to pulling in the direction of tension on the electric cables 16 and 18 which results in a shearing force applied to the stud 32.

As noted above, the mid portion 26 of the strap 20 is wound around electric cable 18. In order to accommodate plug members and receptacle members of varying physical dimensions, the strap 20 is relatively long. When plug members and receptacle members of relatively shorter physical dimensions are involved, the strap 20 is wound around the electric cable more times that it would be otherwise in order to take up the slack. To facilitate turning the mid section 26 of the strap 20 around the electric cable 18, the mid section is made of a rounded cross section which could be either circular, oval, or even rectangular with gently rounded corners. By contrast, the flattened end portions 30 are relatively wider. The flattened end portions extend axially beyond the studs 32 to form tabs which may be gripped to pry the stud 32 out of the socket 22 when it is necessary to unplug the plug member 14 from the receptacle member 12.

Figure 5:
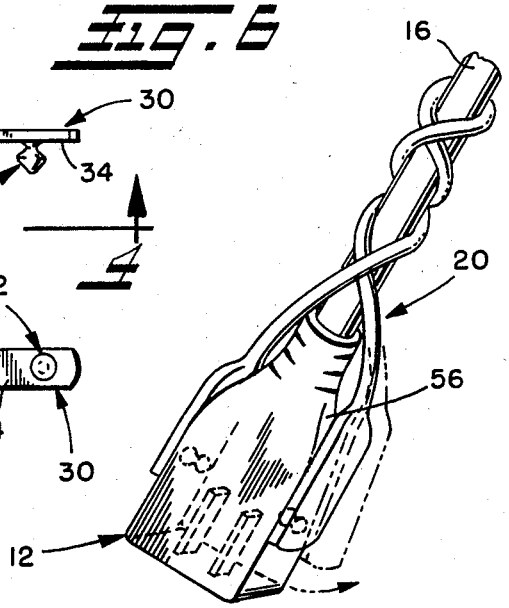
FIG. 5 illustrates the receptacle member of FIG. 2 with a strap wound around the electric cable connected thereto.

The embodiment described with respect to FIG. 1 is suitable for use with an extension cord where the receptacle member 12 forms the female end of the extension cord and the plug member 14 is a conventional plug of, e.g., a power tool or another extension cord. In this case, one of the studs 32 could be left at all times in its corresponding socket. To secure the connection between the plug member 14 and receptacle member 12 the strap 20 is wound in the manner shown until the remaining stud 32 may be aligned with the remaining socket without any undue slack in the strap 20. When not in use, the strap 20 may be stored by wrapping it around cable 16 and inserting both studs 32 into the sockets 22 as shown in FIG. 5. In this way, a totally conventional plug member 14 may be secured to the receptacle member 12.

Figure 6:
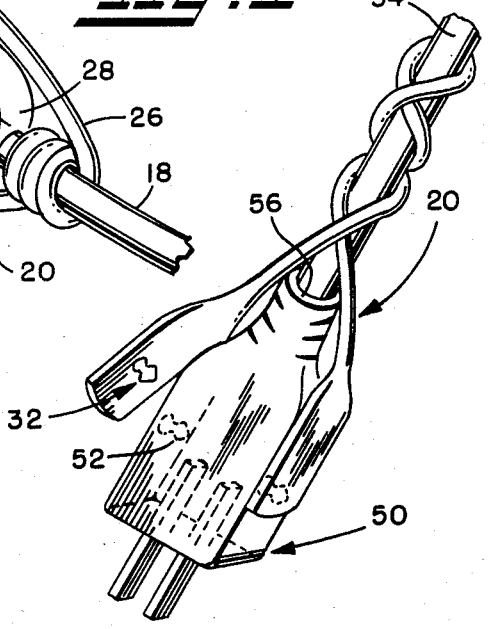
FIG. 6 illustrates a plug member forming a portion of the electrical coupler of FIG. 1 and having a strap wound around the cable connected thereto.

It is also contemplated that plug members such as the plug member 50 (FIG. 6) may be especially constructed for use in the present invention. The plug member 50 is electrically identical with the plug member 14. However, the plug member 50 also includes sockets 52 in the side walls thereof. The sockets 52 are identical in contour to the sockets 22. In this case, when the strap 20 is not in use the studs 32 may be pressed into the sockets 52 to hold the strap 20 on the cable 54 connected with plug 50 while not in use. The strap 20 may then be wound around the cable in the criss-cross manner shown in FIG. 6 rather than in the manner shown in FIG. 1. When in use to secure a connection between the plug 50 and a receptacle member such as receptacle member 12, the mid portion 26 of the strap 20 would be pulled down tight around the shoulder 56 of the plug 50.

Further modifications are also possible and contemplated without exceeding the scope of the invention. For example, the sockets 22 need not be formed in a side wall 24 of a receptacle member 12 as shown in FIG. 1. Instead, the sockets 22 could be formed in the shoulder 56 of the receptacle member 12 or shoulder 28 of the plug member 14. Also other shapes of the studs 32 and sockets 22 are possible.

The following is claimed:

1. A portable electrical coupler subject to disconnection as a result of tensions applied to either or both ends of said electrical coupler which is used in conjunction with temporary wiring devices such as extension cords and the like comprising a receptacle member connected with a free and unconstrained electric cable which may be carried from place to place, a plug member connected with a free and unconstrained electric cable which may be carried from place to place and adapted to be inserted into said receptacle member to permit electricity to flow between said members, and securing means for preventing disconnection of said members caused by axial pulling on the cables, said securing means including a strap with a flexible mid portion adapted to be wrapped around the cable connected with one of said members and having end portions each with a stud projecting laterally therefrom, and means defining a pair of stud receiving sockets in the other of said members.

2. The electrical coupler as set forth in claim 1, wherein said end portions of said strap have flattened cross sections and said studs extend from a major side surface thereof.

3. The electrical coupler as set forth in claim 2, wherein said mid portion of said strap has a rounded cross section.

4. The electrical coupler as set forth in claim 2, wherein said strap includes a tab for facilitating removal of one of said studs from one of said sockets.

5. The electrical coupler as set forth in claim 4, wherein said tab includes an extension of one of said flat end portions beyond the stud projecting therefrom.

6. The electrical coupler as set forth in claim 1, further including surface means defining a pair of stud receiving sockets in said one member for receiving the studs when said securing means is not in use.

7. The electrical coupler as set forth in claim 1, wherein said sockets having inwardly extending shoulders around the entrance thereto, each of said studs having an enlarged head portion and a reduced cross section neck portion between said head portion and the respective one of said end portions of said strap.

8. The electrical coupler as set forth in claim 6, wherein said sockets are proportioned snugly to receive said studs.

9. The electrical coupler as set forth in claim 1, wherein said sockets have a major axis which lies in a plane transverse to the direction of insertion of said plug member into said receptacle member.

10. The electrical coupler as set forth in claim 1, wherein said mid portion is wrapped around a cable at least one complete revolution.

11. The electrical coupler as set forth in claim 10, wherein said mid portion is wrapped around the cable of said one member a sufficient number of revolutions to eliminate slack in said securing means when said studs are in said stud receiving sockets of said other member.

* * * * *